US007338415B2

(12) United States Patent
Giannelli

(10) Patent No.: US 7,338,415 B2
(45) **Date of Patent: *Mar. 4, 2008**

(54) TORSO EXERCISE MACHINE

(75) Inventor: Raymond Giannelli, Franklin, MA (US)

(73) Assignee: Cybex International, Inc., Medway, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/500,614

(22) Filed: Aug. 8, 2006

(65) Prior Publication Data

US 2006/0270531 A1 Nov. 30, 2006

Related U.S. Application Data

(63) Continuation of application No. 10/293,042, filed on Nov. 13, 2002.

(60) Provisional application No. 60/338,039, filed on Nov. 13, 2001.

(51) Int. Cl.
*A63B 21/08* (2006.01)

(52) U.S. Cl. ..... 482/97; 482/95

(58) Field of Classification Search ..... 482/97–100
See application file for complete search history.

(56) References Cited

U.S. PATENT DOCUMENTS 4,500,089 A 2/1985 Jones
4,666,152 A 5/1987 Jones
4,836,536 A 6/1989 Jones
5,549,534 A 8/1996 Parviainen
5,597,375 A 1/1997 Simonson
6,015,372 A * 1/2000 Steffee et al. ..... 482/137
6,059,701 A * 5/2000 George et al. ..... 482/137
6,213,438 B1 4/2001 Ostby et al.
6,354,982 B1 3/2002 Sencil
6,719,672 B1 4/2004 Ellis et al.
2002/0022556 A1* 2/2002 Eriksson et al. ..... 482/92
2002/0128124 A1 9/2002 Mosimann et al.

* cited by examiner

*Primary Examiner*—Lori Amerson
(74) *Attorney, Agent, or Firm*—Rissman Jobse Hendricks & Oliverio

(57) ABSTRACT

The subject invention provides an exercise machine for exercising the lower torso. As described herein, the exercise machine includes a stabilizer pad, which effectively immobilizes the user's lower body to maintain proper pelvic positioning during execution of the exercise. The stabilizer pad can be part of a user support structure having a seat surface, a pelvic stabilizer pad and a footrest. The footrest is positioned so the user can apply a force using the leg muscles to push the pelvis into the pelvic stabilization pad. The spatial arrangement of the stabilization assembly which comprises: pelvic stabilizer pad, seat, and footrest combination effectively immobilize the user's pelvic area, preventing it from rotating in either the anterior or posterior direction.

20 Claims, 5 Drawing Sheets

TORSO EXERCISE MACHINE

CROSS-REFERENCE TO RELATED APPLICATION

This application is related to and claims priority to U.S. Ser. No. 10/293,042, filed Nov. 13, 2002, entitled TORSO EXERCISE MACHINE, which, in turn, is related to and claims priority to Provisional Application Ser. No. 60/338,039, filed Nov. 13, 2001, entitled TORSO EXERCISE MACHINE, the entirety of which is incorporated herein by reference.

STATEMENT REGARDING FEDERALLY SPONSORED RESEARCH OR DEVELOPMENT n/a

FIELD OF THE INVENTION

The present invention relates to a method and system for exercising the lower torso, and more particularly to an exercise machine which includes a stabilizer assembly to effectively immobilize the user's lower body, maintaining proper pelvic positioning and stabilization during execution of the exercise.

BACKGROUND OF THE INVENTION

Proper form is essential for effective and safe results when performing resistive exercises such as with weight machines used for strength training. This is especially true for exercise of the muscle groups found in the torso during spinal extension and spinal flexion exercises, as it is known in the art. This exercise motion focuses on training the lower back muscles, the abdominals, and obliques. Too often however, the various machines and devices available for this purpose lack proper features to ensure that users execute a safe and effective motion thereupon to exercise the back or abdominal muscles.

Many torso exercise machines use a conventional cable and pulley system coupled to a weight stack. A user typically sits on a stationary surface, and then applies his or her upper body against another surface. A user may then apply force on this latter surface whilst rotating the torso about the base of the spine, to either: (a) flex the spine by contracting the abdominal muscles so as to train the abdominal muscles group, or (b) extend the spine by contracting the back muscles so as to train the muscles of the central and lower back. To achieve this range of motion, a user's hips are often unsecured, and may be free to move or shift while the exercise is performed. This allows other skeletal motions such as hip flexion to substitute for spinal flexion and conversely hip extension to substitute for spinal extension. When that is allowed to happen, the user will be exercising the hip and not the abdominals and back musculature. Some torso exercise machines may use a back support to try to limit the extent of spinal extension range especially in the lumbar region of the spine but unless there is some significant force holding the back against this back support, they are traditionally ineffective at stabilizing the pelvis and preventing hip flexion/extension substitution.

It is desirable therefore, to provide a weight training machine which allows a user to exercise his or her muscles in the torso region, while sufficiently stabilizing the pelvis to effectively block hip motion and substitution and focus the training effect on the intended muscles of the abdomen and lower back.

SUMMARY OF THE INVENTION

The subject invention provides an exercise machine for exercising the lower torso. As described herein, the exercise machine includes a pelvic stabilizer assembly, which effectively immobilizes the user's lower body to maintain proper pelvic positioning during execution of the exercise.

For example, the exercise machine of the present invention could be a back extension machine, which includes a user support structure is mounted on the support frame. The user support structure includes a seat surface and a pelvic stabilizer pad. The seat is mounted on a forwardly facing angled upper portion of the support frame, below and at an angle oblique to the pelvic stabilizer pad. The seat is positioned such that the user's lower back and pelvic region abuts the pelvic stabilizer pad and the user's legs extend outwardly and downwardly. The pelvic pad is affixed to the upper end of the support frame and is inclined rearwardly, and being curved in a substantially half-cylindrical shape, to accommodate the user's lower back at full extension.

In addition to the pelvic stabilization pad, the stabilization assembly includes an adjustable footrest is attached to the front of the support frame, such that a user's feet are positioned on the footrest. The footrest can be adjusted back and forth with the footrest adjustment mechanism to accommodate users of varying heights. The footrest is positioned so the user can apply a force using the leg muscles to push the pelvis into the pelvic stabilization pad. The spatial arrangement of the stabilization assembly which comprises: pelvic stabilizer pad, seat, and footrest combination effectively immobilize the user's pelvic area, preventing it from rotating in either the anterior or posterior direction while not interfering with the normal range of motion in extension and flexion of the spine.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
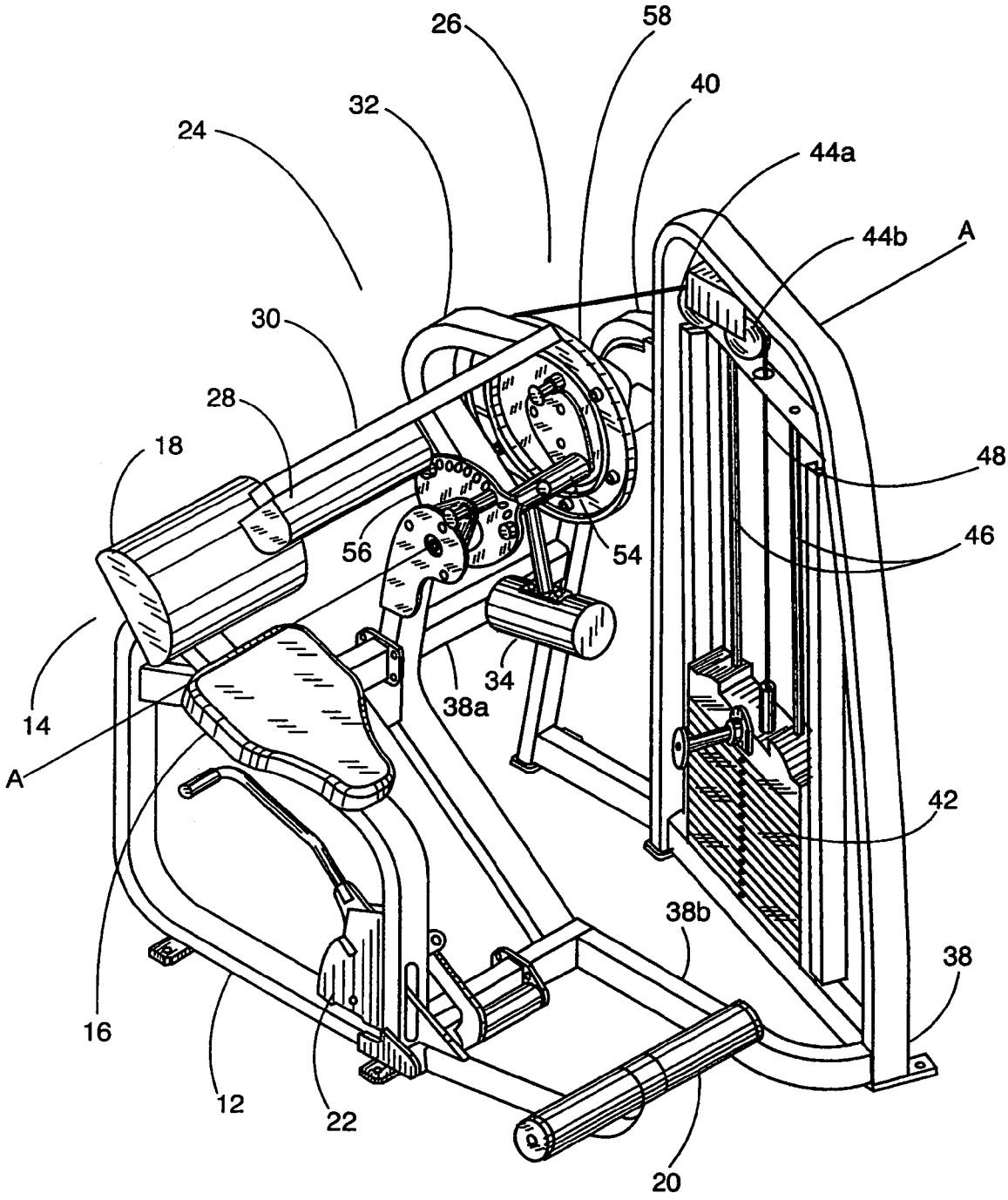
FIG. 1 is a perspective view of a back extension machine of the subject invention.

In an exemplary embodiment, as shown in FIG. 1, a back extension machine 10 of the present invention includes a support frame 12 on which a user support structure 14 is mounted. The user support structure 14 includes a seat surface 16 and a pelvic stabilizer pad 18. The seat 16 is mounted on the forwardly facing angled upper portion of the support frame 12, below and at an angle oblique to the pelvic stabilizer pad 18. The seat 16 is positioned such that the user's lower back and pelvic region abuts the pelvic stabilizer pad 18 and the user's legs extend outwardly and downwardly. The pelvic stabilizer pad 18 is affixed to the upper end of the support frame 12, is inclined rearwardly, and is curved in a substantially half-cylindrical shape to accommodate for the user's lower back.

An adjustable footrest 20 is attached to the front of the support frame 12, where the oblique angle of the seat 16 substantially directs the seat 16 down towards footrest 20. The footrest 20 is positioned so the user can apply a force using the leg muscles to push the pelvis into the pelvic stabilization pad 18. The footrest 20 can be adjusted back and forth with the footrest adjustment mechanism 22 to accommodate users of varying heights. When a user's feet are positioned on the footrest 20, the footrest is adjusted such that the user's thighs are substantially parallel with the ground. Additionally, the user's knees are in a flexion position of between about 10 degrees knee flexion to about 30 degrees knee flexion. This spatial arrangement of the pelvic stabilizer pad 18, seat 16, and footrest 20 combination effectively immobilize the user's pelvic area, preventing it from rotating in either the anterior or posterior direction.

An input assembly 24 is positioned above of the seat 16, and mounted to the support frame 12 for rotation about a horizontal axis A-A, as defined by the range-limiting device 26, described in further detail below. The input assembly 24 includes a padded member 28 affixed to a horizontal arm 30, where the padded member 28 is positioned for engagement of a user's upper back. The horizontal arm 30 is attached to a curved offset arm 32, where the curved offset arm 32 is affixed to the range-limiting device 26, such that the padded member 28 is positioned above the seat 16. A counterweight 34 is attached to the range-limiting device 26 to balance the input assembly 24 about the horizontal axis A-A.

A weight stack brace 36 is attached to the support frame 12 by beams 38*a* and 38*b* and secondary support frame 40, such that the weight stack 42 is easily accessed by a seated user. Weight stack pulleys 44*a* and 44*b* are mounted to the top of the weight stack brace 36, with pulley 44*a* being aligned with the start-positioning device 26 and pulley 44*b* being aligned with the weight stack 42. Rails 46 are mounted vertically within the weight stack brace 36, where the individual plates of the weight stack 42 are slideably mounted to the rails 46 and provide a resistance to the exercise.

The weight stack 42 is selectively connected to one end of a cable 48 by inserting a pin in one of a plurality of holes in a lifting post 50 that passes vertically through the plates, as is well known in the art. For example, the weight stack 42 is formed by a stack of rectangular, brick-shaped plates 52. Each plate 52 further has at least one horizontal channel or hole, wherein a pin may be disposed to slideably engage any of a series of horizontal channels which are vertically oriented on the lifting post 50 in a spaced apart manner to match the vertical spacing of the stacked weight plates 52. The pin thereby engages a portion of the stack of weight plates 52, such that when vertical force is applied to the lifting post 50, the selected stack of weight plates 52 is moved upwards to create a resistance. Typically, the weight stack 42 apparatus is oriented such that the further down the pin is entered into the lifting post 50, the greater the number of plates 52 are engaged, thereby increasing the resistance of the machine.

The cable 48 extends up from the weight stack 42 and a portion of cable 48 extends over pulleys 44*a* and 44*b*. The second end of the cable 48 is connected to the start-positioning device 26, thereby inhibiting rotation of the start-positioning device.

Additionally, the weight stack 42 can be connected to the start-positioning device 26 by other means known in the art, including, but not limited to, belts, cables, chains, or tethers, so as to inhibit rotation thereof.

In alternative embodiments, other mechanisms for providing resistance, such as friction fittings, springs, elastic bands, pneumatic or electromagnetic resistance, or an air resistance fan could be employed (either alone or in combination) and still practice the invention. Additionally, free weights could be operably engaged to the transmission assembly to resist the movement.

Figure 2:
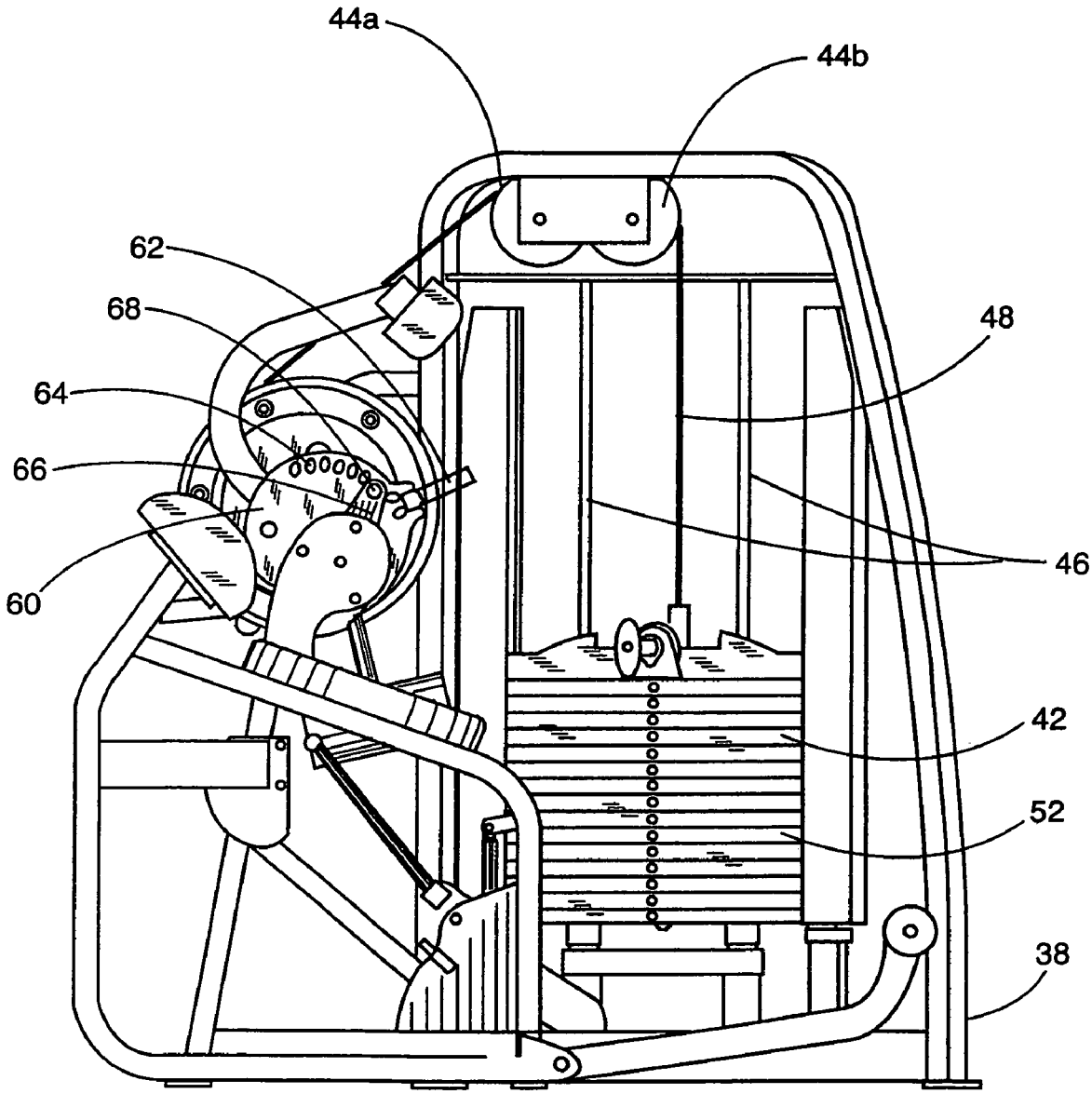
FIG. 2 is a side view of a back extension machine of the subject invention.

As shown in FIG. 1, the range-limiting device 26 includes a horizontal shaft 54, defining the horizontal axis of rotation A-A, the horizontal shaft 54 being pivotally connected to the support frame 22 and the secondary support frame 40. An end-positioning device 56 and a start-positioning device 58 are affixed to the horizontal shaft 54. The end-positioning device 56 includes a detent plate 60 having a horizontal stop 61, a handle element 62, and defining a plurality adjustment holes 64. (See also FIG. 2). The detent plate 60 is rotateably affixed about the horizontal shaft 54 and affixable to the support frame's stop arm 66 by the engagement of stop pin 68 to one of the detent plate's adjustment holes 64. The detent plate's vertical stop 61 is positioned for engagement of the curved offset arm 32, where the horizontal stop 61 limits the angle of rotation of the input assembly 24.

Figure 3:
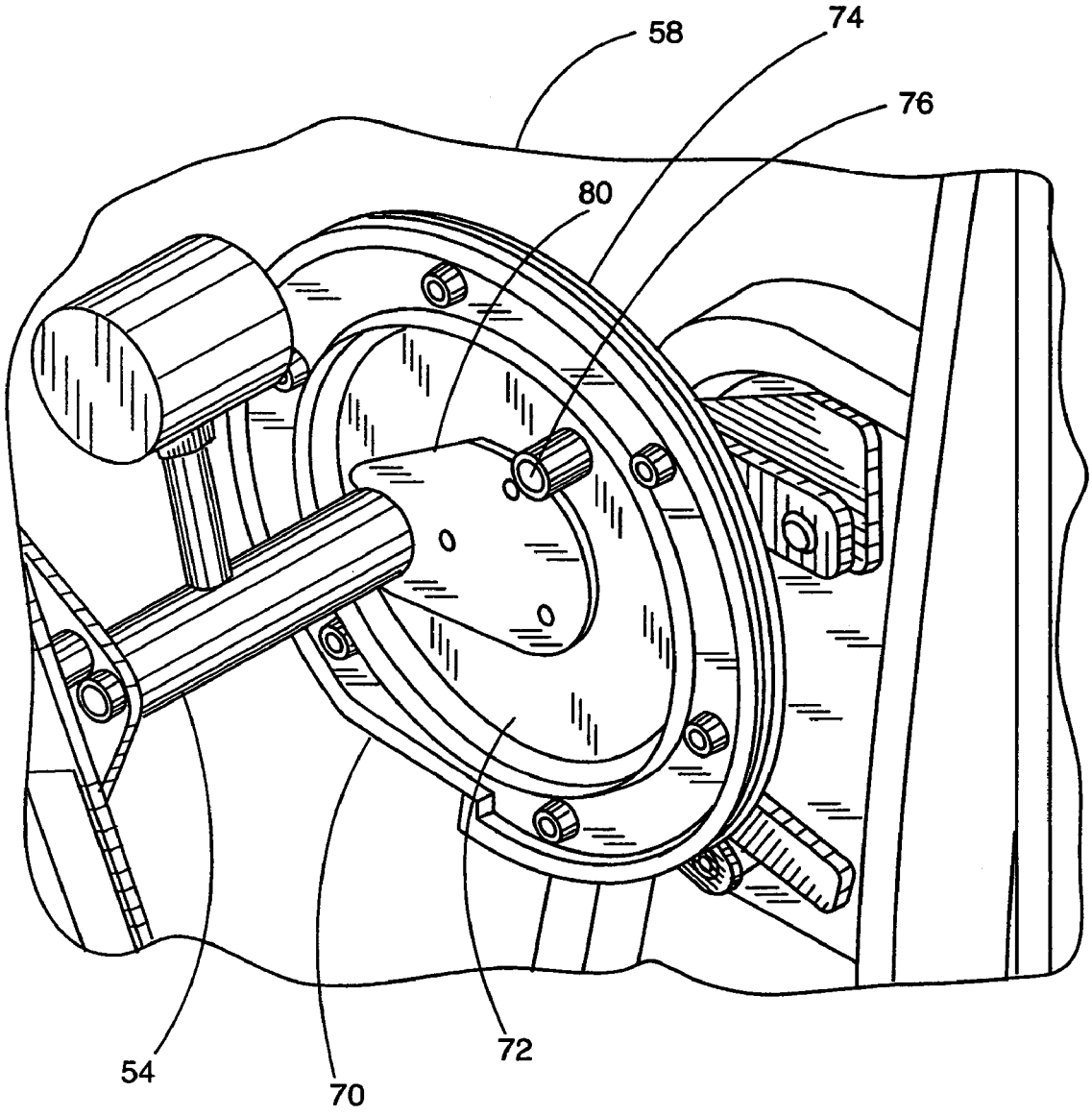
FIG. 3 is a left side perspective view of the start-positioning device of the subject invention.
Figure 4:
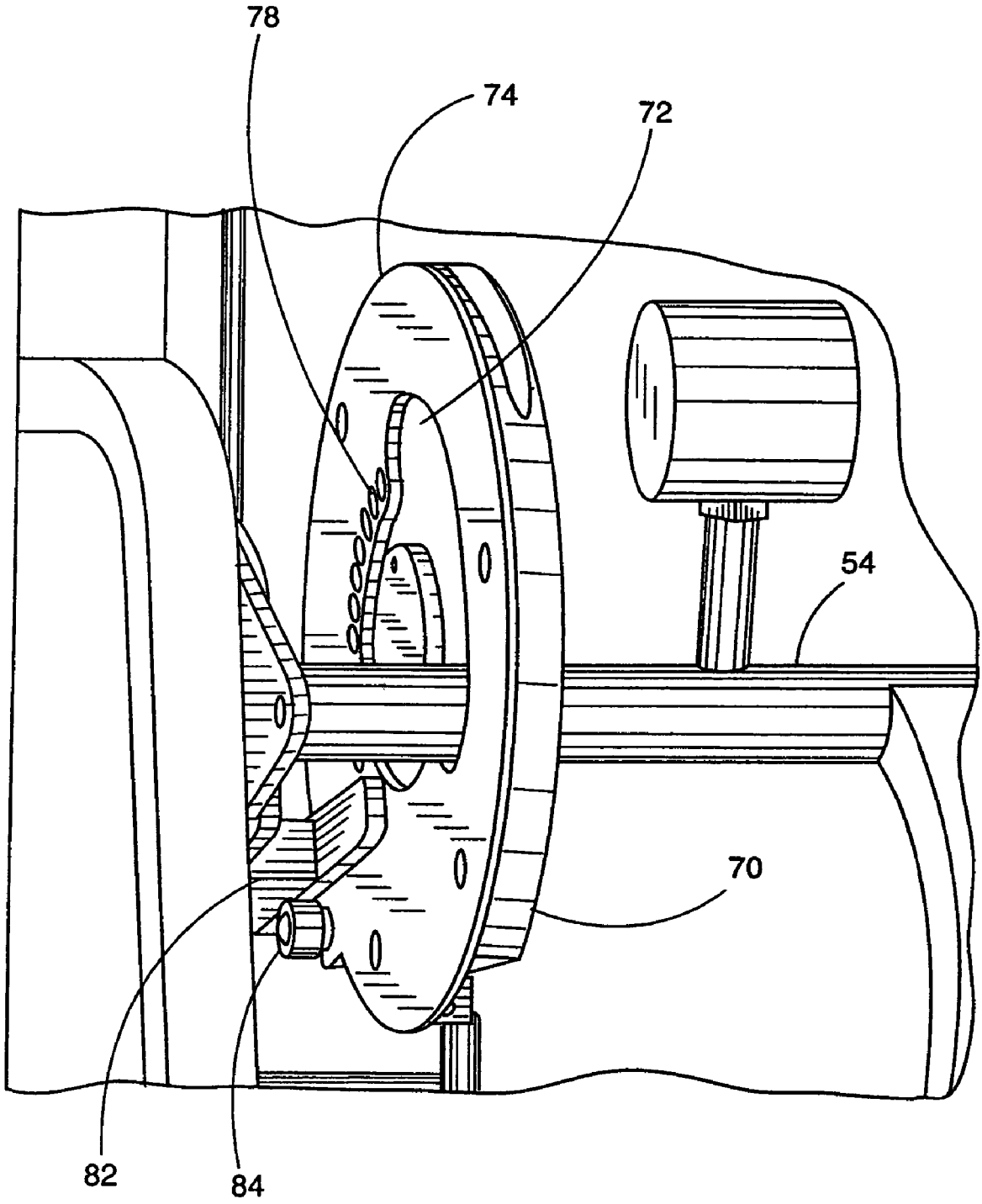
FIG. 4 is a right side perspective view of the start-positioning device of the subject invention.

As shown in FIGS. 3 and 4, the start-positioning device 58 is affixed to the horizontal shaft 45, and includes a cam 70, eccentric plate 72, and a cam plate 74. The cam 70 is configured to receive the eccentric plate 72, such that the eccentric plate 72 is rotateable within the cam 70. The cam plate 74 is attached to the cam 70, sealing the eccentric plate 72 within the cam 70, such that the cam 70 and cam plate 74 are rotateable about the eccentric plate 72. The eccentric plate 72 includes a cam pin 76 for engaging the cam plate's adjustment holes 78. The eccentric plate 72 is attached to the horizontal shaft's offset mounting arm 80, such the axis of rotation of the eccentric plate 72 is offset from the eccentric plate's central axis.

As noted above, the eccentric plate 72 is attached to the horizontal shaft's offset mounting arm 80, such the axis of rotation of the eccentric plate 72 is offset from the eccentric plate's central axis. Accordingly, as the eccentric plate 72 rotates within the cam 70, the radial positioning of the cam 70 about the horizontal shaft 54 is changed, changing the effective radius of curvature of the cam 70 with respect to the input assembly 24. The automatic change in the effective radius of curvature of the cam 70 provides an automatic change in the mechanical advantage over the adjusted range of motion, thus providing the correct anatomical mechanical advantage for the adjusted range of motion.

In an exemplary method of use, the end-positioning device 56 and the start-positioning device 58 are used in conjunction to adjust the exercise start and stop positions. Initially, the user adjusts the start position as noted above. In doing so, the effective radius of curvature of the cam 70 is changed, providing the appropriated mechanical advantage for the new start position. The user can then adjust the stop position as noted above, thereby provided a limited range of motion for the exercise.

Figure 5:
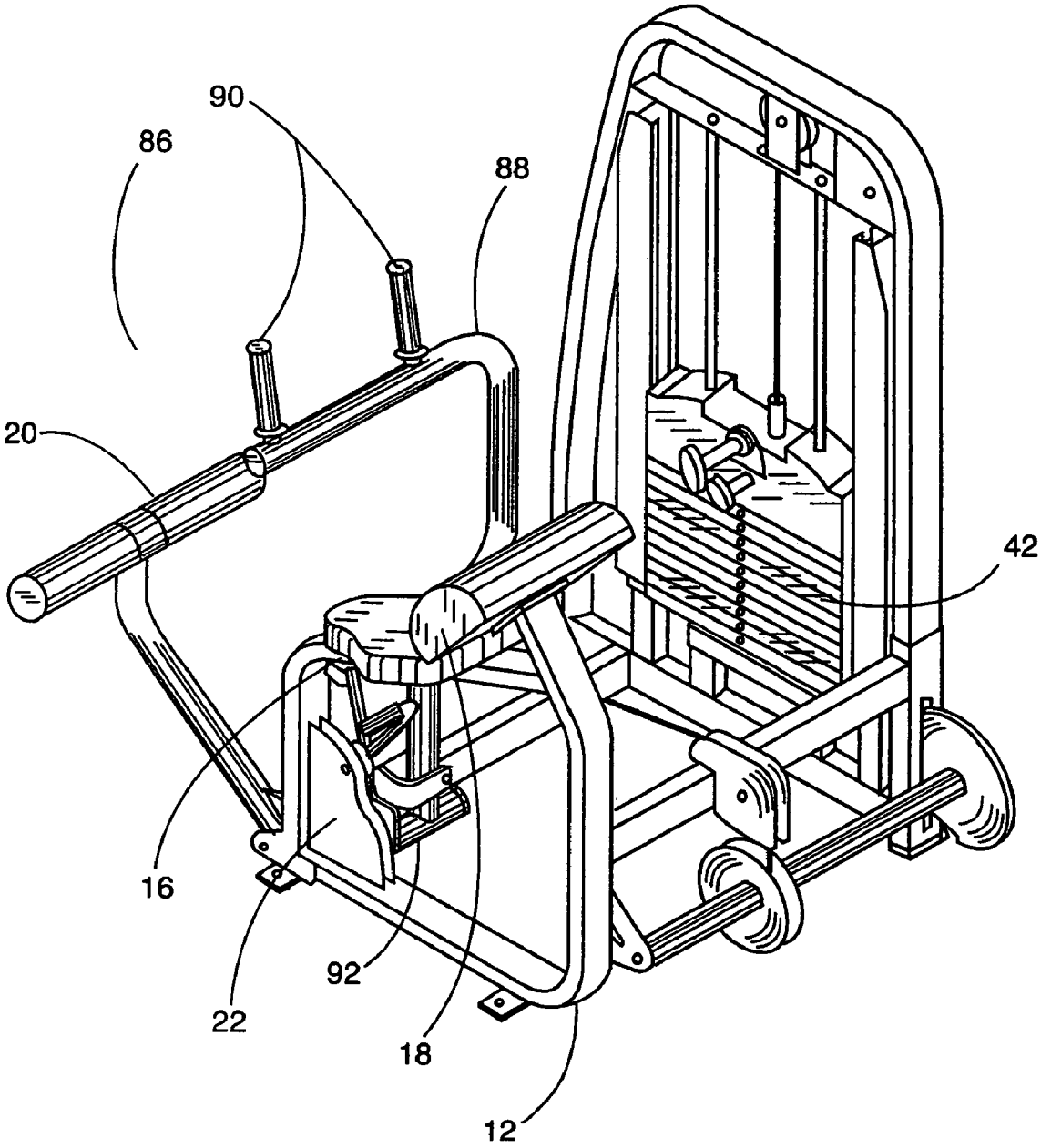
FIG. 5 is a perspective view of an abdominal machine in accordance with the invention.

Referring now to FIG. 5, the present invention is shown in the context of an abdominal machine 86, which includes support frame 12 on which a user support structure 14 is mounted. The user support structure 14 includes a seat surface 16 and a pelvic stabilizer pad 18. The seat 16 is mounted on the forwardly facing angled upper portion of the support frame 12, below and at an angle oblique to the pelvic stabilizer pad 18. The seat 16 is positioned such that the user's lower back and pelvic region abuts the pelvic stabilizer pad 18 and the user's legs extend outwardly and downwardly. The pelvic stabilizer pad 18 is affixed to the upper end of the support frame 12, is inclined rearwardly, and is curved in a substantially half-cylindrical shape to accommodate for the user's lower back.

The adjustable footrest 20 is attached to the front of the support frame 12, where the oblique angle of the seat 16 substantially directs the seat down towards footrest 20. The footrest 20 is positioned so the user can apply a force using the leg muscles to push the pelvis into the pelvic stabilization pad 18. The footrest 20 can be adjusted back and forth with the footrest adjustment mechanism 22 to accommodate users of varying heights. When a user's feet are positioned on the footrest 20, the footrest is adjusted such that the users thighs are substantially parallel with the ground. Additionally, the user's knees are in a flexion position of between about 10 degrees knee flexion to about 30 degrees knee flexion. This spatial arrangement of the pelvic stabilizer pad 18, seat 16, and footrest 20 combination effectively immobilize the user's pelvic area, preventing it from rotating in either the anterior or posterior direction.

In the abdominal machine 86, the input assembly 12 includes a horizontal arm 88 fitted with handles 90, where the horizontal arm 88 and arm handles 90 are position directly in front of the user. The horizontal arm 88 pivots about a hinge 92 positioned substantially below the seat 16, such that handles 90 travel in a substantially liner path as the user pushes against the arm handles 90.

In a method of use, the user extends their arms until the elbows are fully extended. While keeping the elbows locked at zero degrees of flexion, the user will alternately flex the spine in a forward bending motion and extend the spine in a rearward bending motion. As such, the user's upper torso faces a substantially linear path of resistance, such that the body's abdominal muscles are effectively contracted and exercised. The user uses his arms to push the arm handles 90, and hence the path of resistance offered by the weight stack 42 flows directly through the user's hands, arms, and shoulders, and only then along the length of the torso. The user must then contract the entire length of his or her frontal abdominal wall. The stabilization assembly effectively locks the pelvis in one position essentially blocking the hip muscles from use during the exercise. This forces the abdominals to do all the work. To end the exercise, the user simple bends the elbows, removing the force exerted by the weight stack 42 on the user.

Alternatively, the user may grasp handle 90 with only one hand while still flexing and extending the spine in the forward and rearward direction, such that by pushing on the arm handles 90, the oblique abdominals may be exercised either on the left or right side of the torso.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A lower torso exercise machine comprising:

a frame;

a seat and a stabilizing pad mounted to the frame, the seat being mounted below and at an angle oblique to the pelvic stabilizing pad; and, a handle assembly movably mounted to the frame and operatively connected to a resistance mechanism, the handle assembly comprising a handle mechanism disposed above and in front of the seat for manual pushing engagement by a user seated on the seat, the handle assembly being movable on pushing engagement by the user to oppose the resistance mechanism.

2. The lower torso exercise machine of claim 1 wherein the handle assembly is pivotably mounted to the frame at a pivot position below the seat.

3. The lower torso exercise machine of claim 2 wherein the handle assembly is pivotably mounted such that the handle mechanism is movable by the user in a substantially linear path.

4. The lower torso exercise machine of claim 1 further comprising a footrest mounted on the frame in front of the seat.

5. The lower torso exercise machine of claim 4 wherein the footrest is mounted such that the footrest is positioned relative to the seat such that a user's thighs are disposed substantially parallel to the ground on engagement of the user's feet with the footrest.

6. The lower torso exercise machine of claim 4 wherein the oblique angle is such that the seat is directed towards the footrest.

7. The lower torso exercise machine according of claim 4 wherein the footrest is mounted such that the footrest is positioned relative to the seat to enable pushing engagement of the user's lower back against the stabilization pad.

8. The lower torso exercise machine according to claim 1 wherein the stabilizing pad is substantially half-cylindrical in shape.

9. The lower torso exercise machine according to claim 1, further comprising an input assembly engageable by a user; and a resistance mechanism operably connected to the input assembly.

10. The lower torso exercise machine according to claim 9, wherein the input assembly includes a padded member affixed to a horizontal arm, wherein the padded member is positioned substantially above the seat and engageable by a user's upper back.

11. Method of exercising muscles of a user's lower torso comprising:

seating the user on a seat mounted at an oblique angle relative to horizontal;

stabilizing a pelvis of the user with a footrest disposed in front of the seat in a position by engagement of the user's feet with the footrest to push the pelvis of the user into engagement with a stabilizing pad mounted above and behind the seat;

contracting the user's abdominal muscles by pushing engagement of the user's arms against a handle assembly operatively connected to a resistance mechanism, the user simultaneously maintaining pelvic engagement with the stabilizing pad by foot engagement with the footrest.

12. The method of claim 11 wherein the footrest is mounted to the frame in a position relative to the seat such the user's thighs are disposed substantially parallel to the ground when the user's feet are engaged with the footrest.

13. The method of claim 11 wherein the footrest is mounted to the frame in a position relative to the seat to enable pushing engagement of the user's lower back against the stabilization pad.

14. The method of claim 11 wherein the handle assembly comprises a handle mechanism positioned substantially above the seat and pushably engageable with a user's hands by extension of the user's arms.

15. The method of claim 14 wherein the handle assembly is pivotably mounted such that the handle mechanism is movable in a substantially linear path on pushing engagement with the user's hands.

16. A lower torso exercise machine comprising:

a frame;

a seat mounted on the frame at an oblique angle to horizontal;

a footrest mounted on the frame in a position in front of the seat such that when a user is seated on the seat, the user's feet are pushably engageable on the footrest to extend the user's legs;

a handle assembly movably mounted to the frame and operatively connected to a resistance mechanism, the handle assembly comprising a handle mechanism disposed above and in front of the seat for manual pushing engagement by a user seated on the seat, the handle assembly being movable on pushing engagement by the user to oppose the resistance mechanism.

17. The lower torso exercise machine of claim 16 further comprising a stabilizing pad mounted above and behind the seat.

18. The lower torso exercise machine of claim 16 wherein the footrest is mounted such that the footrest is positioned relative to the seat such that a user's thighs are disposed substantially parallel to the ground on engagement of the user's feet with the footrest.

19. The lower torso exercise machine of claim 16 wherein the oblique angle is such that the seat is directed towards the footrest.

20. The lower torso exercise machine according of claim 16 wherein the footrest is mounted such that the footrest is positioned relative to the seat such that a user's knees are disposed in an angle of flexion between about 10 degrees knee flexion to about 30 degrees knee flexion when the user's feet are engaged with the footrest.

* * * * *